US005807442A

United States Patent [19]

Goodreau

[11] Patent Number: 5,807,442

[45] Date of Patent: Sep. 15, 1998

[54] CHROMATE PASSIVATING AND STORAGE STABLE CONCENTRATE SOLUTIONS THEREFOR

[75] Inventor: Bruce H. Goodreau, Shelby Township, Mich.

[73] Assignee: Henkel Corporation, Plymouth Meeting, Pa.

[21] Appl. No.: 881,558

[22] Filed: Jun. 24, 1997

Related U.S. Application Data

[63] Continuation of Ser. No. 638,268, Apr. 26, 1996, abandoned.

[51] Int. Cl.[6] ..... C23C 22/48

[52] U.S. Cl. ..... 148/247; 148/258; 148/261; 148/264; 148/268

[58] Field of Search ..... 148/247, 258, 148/264, 261, 268

[56] References Cited

U.S. PATENT DOCUMENTS

| | | | |
|---|---|---|---|
| 2,868,682 | 1/1959 | Dell | 148/258 |
| 2,936,254 | 5/1960 | Newhardt | 184/258 |
| 3,477,882 | 11/1969 | Coulman | 148/258 |
| 4,668,305 | 5/1987 | Dollman et al. | 148/6.16 |
| 4,749,418 | 6/1988 | Saeki et al. | 148/6.16 |
| 5,091,023 | 2/1992 | Saeki et al. | 148/247 |
| 5,332,452 | 7/1994 | Das | 148/247 |
| 5,451,271 | 9/1995 | Yoshida | 148/258 |

*Primary Examiner*—David A. Simmons
*Assistant Examiner*—Robert R. Koehler
*Attorney, Agent, or Firm*—Wayne C. Jaeschke; Norvell E. Wisdom, Jr.; Frank E. Robbins

[57] ABSTRACT

A concentrated aqueous solution containing:

(A) a component of dissolved phosphate ions;

(B) a component of dissolved hexavalent chromium;

(C) a component of dissolved anions selected from the group consisting of $BF_4^-$, $AlF_6^{-3}$, $SiF_6^{-2}$, $TiF_6^{-2}$, $FeF_6^{-3}$, $SnF_6^{-2}$, $ZrF_6^{-2}$, and $HfF_6^{-2}$; and (D) a component of free fluoride ions; and, optionally and preferably, (E) a component of dissolved trivalent chromium; and, optionally, one or more of:

(F) a component of dissolved organic substances produced by reducing some hexavalent chromium initially added to trivalent chromium;

(G) a component of dissolved, stably suspended, or both dissolved and stably suspended film forming polymer molecules; and (H) a component of dissolved, stably suspended, or both dissolved and stably suspended substances selected from the group consisting of silica and silicates is more resistant to development of precipitates during extended storage than similar compositions without the free fluoride component, and upon dilution makes at least equally satisfactory working compositions for forming a chromate conversion "passivating" coating on zinciferous surfaces.

20 Claims, No Drawings

CHROMATE PASSIVATING AND STORAGE STABLE CONCENTRATE SOLUTIONS THEREFOR

CROSS-REFERENCE TO RELATED APPLICATION

This application is a continuation of application Ser. No. 08/638,268 filed Apr. 26, 1996, now abandoned.

BACKGROUND OF THE INVENTION

1. Field of the Invention

This invention relates to treatment of metal surfaces to enhance their resistance to corrosion, more particularly to a class of liquid treatment compositions that herein are called "passivators" or "passivating" compositions, solutions, or the like. These liquid treatment compositions, when brought into contact with metal surfaces that are chemically "active", in particular with steel and zinciferous surfaces such as those of galvanized steel, react chemically with the metal surfaces, without any need for externally applied electromotive force, to form on the metal surface an adherent layer coating which (i) has very low solubility in water, (ii) normally contains some cations derived from the metal surface and some anions derived from the treatment composition, and (iii) enhances the resistance of the metal surfaces as so treated to corrosion by many normally corrosive aqueous liquid compositions that may later come into contact with the metal surfaces so treated, compared with the same metal surface that has not been treated.

Such protective coatings are often denoted in the art as "conversion coatings", and the treatment compositions that form them are correspondingly alternatively known in the art as "conversion coating" compositions, solutions, or the like. This invention is more particularly related to the well known class of conversion coatings that contain chromium, at least some of which is hexavalent, and accordingly are known in the art as "chromate" conversion coatings, and still more particularly related to aqueous treatment compositions that form such conversion coatings and that contain both dissolved phosphate anions and at least one of fluozirconate, fluotitanate, fluosilicate, fluoborate, and fluoaluminate anions also in solution along with chromium.

2. Statement of Related Art

A variety of aqueous chromium containing passivating compositions that also contain phosphate and one of the fluorometallate ions noted above are known in the art, for example as taught in U.S. Pat. Nos. 5,091,023 of Feb. 25, 1992 to Saeki et al., 4,749,418 of Jun. 7, 1988 to Saeki et al., 4,668,305 of May 26, 1987 to Dollman et al., all of which, to the extent not inconsistent with any explicit statement herein, are hereby incorporated herein by reference. Such materials are commonly distributed in commerce in aqueous solutions that are much more concentrated in active ingredients than the working aqueous compositions actually contacted with metal surfaces during treatment, these working compositions being normally formed by diluting the concentrated compositions as transported with additional water at or near the point of use, in order to avoid the cost of transporting chemically inactive water. However, it has been observed that highly concentrated compositions of the types taught in the prior art are often unstable during storage, specifically that, even though initially prepared as apparently homogeneous solutions, they form increasing amounts of solid precipitate when stored under normal conditions. Such precipitate rarely if ever will easily redissolve, even if suspended in the concentrated solutions and diluted with additional water, and the precipitates contain substantial amounts of the active ingredients of the concentrated composition that are needed in aqueous solution in the working composition made from it. As a result of this problem, practical use of compositions of this type has been impeded.

DESCRIPTION OF THE INVENTION

1. Object of the Invention

A major object of the present invention is to provide concentrated compositions of the type noted above in the form of aqueous solutions that remain stable in concentration during extended storage. An alternative or concurrent object is to provide improved corrosion resistance from the passivating treatment. Other objects will be apparent from the description below.

2. General Principles of Description

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; the term "mole" means "gram mole", and the term itself and all its grammatical variations may be applied to ionic, elemental, or any other chemical entities defined by the types of atoms contained therein and the number of atoms of each type, as well as to compounds with conventional well-defined neutral molecules; chemical descriptions of neutral materials apply to the materials at the time of addition to any combination specified in the description and/or of generation within the composition by chemical reactions explicitly specified in the description, and do not necessarily preclude other chemical changes to the materials as a result of reaction in the combination; specification of materials in ionic form means that the materials are supplied to prepare the compositions containing them in the form of soluble salts or other compounds that contain the ions specified and/or are generally believed in the art to ionize in solution to form such ions and implies the presence in any composition specified to contain ionic materials of sufficient counterions to produce electrical neutrality for the composition as a whole; any counterions thus implicitly specified preferably are selected from among other constituents explicitly specified in ionic form, to the extent possible; otherwise such counterions may be freely selected, except for avoiding counterions that act adversely to the object(s) of the invention.

SUMMARY OF THE INVENTION

It has been found that the presence of "free fluoride ions" in concentrated aqueous solutions containing phosphate, chromate, and fluorometallate ions increases the stability of the concentrated compositions against the formation of solid precipitates during storage. In many instances, the presence of free fluoride ions in working compositions has also been found to improve the degree of corrosion protection achieved by treatment with the compositions. "Free" fluoride ions are defined for this purpose as any fluorine atoms present in the aqueous solutions in excess over the stoichiometric amount of fluorine atoms necessary to form perfluorinated complex anions with all dissolved atoms selected from the group consisting of boron, aluminum, silicon, titanium, iron, zirconium, tin, and hafnium that are present in the same solutions in a chemical form that is chemically reactive, with a reaction half-life not greater than 100 days at 25° C., to form complex anions containing at least one atom per anion selected from the group consisting of boron, aluminum, silicon, titanium, iron, zirconium, tin, and hafnium together with at least one atom of fluorine.

Accordingly, one major embodiment of the invention is an aqueous solution comprising, preferably consisting essentially of, or more preferably consisting of, water and:

(A) a component of dissolved phosphate ions;

(B) a component of dissolved hexavalent chromium;

(C) a component of dissolved anions selected from the group consisting of $BF_4^-$, $AlF_6^{-3}$, $SiF_6^{-2}$, $TiF_6^{-2}$, $FeF_6^{-3}$, $SnF_6^{-2}$, $ZrF_6^{-2}$, and $HfF_6^{-2}$; and (D) a component of dissolved free fluoride ions; and, optionally and preferably, (E) a component of dissolved trivalent chromium; and, optionally but not necessarily preferably, one or more of the following components:

(F) a component of dissolved, stably suspended, or both dissolved and stably suspended organic substances produced by reducing some hexavalent chromium previously present in the composition to trivalent chromium;

(G) a component of dissolved, stably suspended, or both dissolved and stably suspended film forming polymer molecules; and (H) a component of dissolved, stably suspended, or both dissolved and stably suspended substances selected from the group consisting of silica and silicates.

In this description, "stably suspended" means that the component so described can be dispersed by mixing, within one hour of its introduction into the liquid phase in which the component in question is described as stably suspended, to produce a liquid mixture which has only one bulk phase detectable with unaided normal human vision and does not spontaneously develop any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed. (The word "bulk" in the preceding sentence means that, to be considered as a bulk phase, a phase must occupy at least one volume of space that is sufficiently large to be visible with unaided normal human vision and is separated from at least one other phase present in the dispersion by a boundary surface that can be observed with unaided normal human vision. Therefore, a change of the composition from clear to hazy or from hazy to clear does not indicate instability of a dispersion within this definition, unless a separate liquid or solid phase develops in the mixture in at least one volume large enough to see independently with unaided normal human vision.)

Also, in this description of an aqueous solution composition according to the invention, and in the additional descriptions below, phosphoric acid itself and any anions produced by the partial ionization of phosphoric acid are to be understood, for the purpose of evaluating whether an actual composition does or does not conform to a particular description, to be present in the composition in the form of their stoichiometric equivalent as phosphate ions, irrespective of the actual degree of ionization. Furthermore, although orthophosphoric acid and its salts are normally preferred, metaphosphoric acid, the condensed phosphoric acids conforming to the general formula $H_{(n+2)}P_nO_{(3n+1)}$, and the partial or complete salts of all of these acids may also be used as phosphate sources, and, if present, their total stoichiometric equivalent as $PO_4^{-3}$ is to be considered part of the phosphate ions content of the solution.

Similarly, acids and partially acidic anions corresponding formally to addition of any number of hydrogen ions, up to the number required to result in electrical neutrality, to the anions specified above as constituents of component (C), which are present in any composition according to the invention are to be considered as part of component (C) thereof, to the extent of their stoichiometric equivalence as the anion recited above for component (C) that contains the same atom other than fluorine as does the acid or partially acid anion.

Other embodiments of the invention include working aqueous metal treating compositions made by diluting concentrated solutions as described above with water, processes of making the concentrated solutions and of using the working compositions as described above by contacting the working compositions with a metal substrate to form a protective coating thereon, and articles of manufacture including a metal substrate surface protected by having been contacted with a working composition according to the invention.

DETAILED DESCRIPTION OF THE INVENTION, INCLUDING PREFERRED EMBODIMENTS

At least partially for reasons of economy, orthophosphoric acid is the most preferred source of phosphate ions component (A), and irrespective of the source, the total phosphate concentration in a concentrated solution according to the invention preferably is at least, with increasing preference in the order given, 20, 30, 40, 50, 60, 70, 75, 80, 85, 90, or 92 grams per liter (hereinafter usually abbreviated as "g/L") and independently preferably is not more than, with increasing preference in the order given, 300, 250, 225, 200, 175, 150, 125, 115, 105, 100, or 95 g/L.

The hexavalent chromium for component (B) of a composition according to the present invention is normally preferably obtained by the addition of the chemical having the formula $CrO_3$, which is variously named as "chromic acid", "chromium trioxide", or "chromic [acid] anhydride". Hexavalent chromium alternatively may be supplied in a composition according to the invention by use of soluble chromate and dichromate salts, such as the alkali metal and ammonium salts. The total concentration of chromium in a concentrated aqueous solution according to the invention, a total concentration value which includes both the chromium in hexavalent chromium component (B) and any chromium in trivalent chromium optional component (E) when that component is present, this total being measured as its stoichiometric equivalent as $CrO_3$, preferably is at least, with increasing preference in the order given, 75, 100, 125, 150, 175, 200, 225, 250, 265, 280, 287, or 292 g/L and independently preferably is not more than, with increasing preference in the order given, 600, 550, 500, 475, 450, 425, 400, 375, 350, 325, 310, 300, or 295 g/L.

Independently of their actual concentrations, total chromium and phosphate ions preferably are present in any composition according to the invention in amounts having a ratio of stoichiometric equivalent as $CrO_3$ of the total chromium to phosphate that is at least, with increasing preference in the order given, 0.50:1.0, 0.75:1.0, 1.0:1.0, 1.25:1.0, 1.50:1.0, 1.75:1.0, 2.0:1.0, 2.25:1.0, 2.5:1.0, 2.75:1.0, 2.85:1.0, 2.95:1.0, 3.05:1.0, 3.10:1.0, or 3.15:1.0 and independently preferably is not more than, with increasing preference in the order given, 10:1.0, 8.0:1.0, 7.0:1.0, 6.0:1.0, 5.5:1.0, 5.0:1.0, 4.5:1.0, 4.0:1.0, 3.7:1.0, 3.5:1.0, or 3.3:1.0.

Fluorometallate component (C) may be provided by acids or salts containing one of the above specified elements with which fluorine forms complex anions. Preferably, fluozirconic and fluotitanic acids and their salts are used for component (C), with fluozirconic acid and its salts most preferred. Irrespective of its chemical nature, component (C) preferably is present in a concentrated aqueous solution according to the invention in a concentration that is at least, with increasing preference in the order given, 0.0060, 0.010, 0.014, 0.018, 0.022, 0.026, 0.030, 0.032, 0.034, 0.036, or 0.038 moles per liter (hereinafter usually abbreviated as "M/L") and independently preferably is not more than, with increasing preference in the order given, 0.6, 0.4, 0.20, 0.16, 0.12, 0.080, 0.070, 0.060, 0.055, 0.050, 0.048, 0.046, 0.044, 0.042, 0.040, or 0.039 M/L. Irrespective of their chemical nature and actual concentrations, components (C) and (A) are preferably present in any composition according to the invention in such amounts that there is a ratio of moles of component (A) to moles of component (C) that is at least, with increasing preference in the order given, 5:1.0, 7:1.0, 9:1.0, 11:1.0, 13:1.0, 15:1.0, 17:1.0, 19:1.0, 21:1.0, 23:1.0, or 25:1.0 and independently preferably is not more than, with increasing preference in the order given, 100:1.0, 80:1.0, 70:1.0, 60:1.0, 55:1.0, 50:1.0, 45:1.0, 40:1.0, 35:1.0, 31:1.0, or 27:1.0.

Free fluoride component (D) may be supplied from any suitable source, such as hydrofluoric acid and water soluble neutral and acid salts of hydrofluoric acid. Hydrofluoric acid is normally preferred, at least partially for reasons of economy, and the total concentration of component (D), measured as its stoichiometric equivalent as HF whether or not actually present in that chemical structure, in a concentrated aqueous solution according to the invention preferably is at least, with increasing preference in the order given, 0.1, 0.3, 0.5, 0.7, 0.9, 1.1, 1.3, 1.5, 1.7, 1.9, 2.1, 2.3, 2.5, 2.7, 2.9, 3.1, or 3.3 g/L and independently preferably is not more than, with increasing preference in the order given, 25, 20, 15, 10, 8, 7.0, 6.0, 5.0, 4.5, 4.0, or 3.5 g/L. Generally, higher concentrations of component (D) favor the stability of concentrated aqueous solutions according to the invention, but too high a concentration of component (D) can lead to too vigorous an attack on the metal being treated by a working composition that is made by diluting a concentrated aqueous solution according to the invention that has too much free fluoride. If excessively vigorous attack on the metal surface occurs, the corrosion protective value of the coating layer formed on the metal is diminished, and in extreme cases, no adherent coating layer at all may result. Irrespective of their actual concentrations, the ratio of the molar concentration of component (D) to the molar concentration of component (C) preferably is at least, with increasing preference in the order given, 2.0:1.0, 2.5:1.0, 3.0:1.0, 3.5:1.0, 3.8:1.0, 4.1:1.0, or 4.3:1.0 and independently preferably, at least partially for reasons of economy, is not more than 50:1.0, 40:1.0, 30:1.0, 20:1.0, 15:1.0, 12:1.0, 10:1.0, 8.0:1.0, 7.0:1.0, 6.5:1.0, 6.0:1.0, 5.5:1.0, 5.1:1.0, 4.8:1.0, or 4.6:1.0.

As already noted, the presence in a composition according to the invention of optional trivalent chromium component (E) is normally preferred. Trivalent chromium ions can be added directly to water in the course of preparing a composition according to the invention by use of salts of trivalent chromium cations, or, preferably, trivalent chromium component (E) may be obtained by adding hexavalent chromium during the course of preparing a composition according to the invention in an amount higher than is desired to retain its hexavalent character in the final composition and then converting part of the hexavalent chromium into trivalent chromium by the addition of a reductant such as tannic acid, starch, alcohol, hydrazine, sucrose, and the like. Polyvinylalcohol is most preferred as the reductant, because it is more likely to result in a concentrated solution according to the invention that is free from cloudiness. Preferred amounts of reductant depend on the amount of reduction achieved by their use; the ratio of trivalent chromium to total chromium in a composition according to the invention preferably is at least, with increasing preference in the order given, 0.10:1.0, 0.15:1.0, 0.20:1.0, 0.25:1.0, 0.29:1.0, 0.32:1.0, 0.35:1.0, 0.38:1.0, 0.40:1.0, 0.42:1.0, 0.44:1.0, or 0.45:1.0 and independently preferably is not more than, with increasing preference in the order given, 0.95:1.0, 0.90:1.0, 0.85:1.0, 0.80:1.0, 0.75:1.0, 0.70:1.0, 0.65:1.0, 0.60:1.0, 0.57:1.0, 0.54:1.0, 0.52:1.0, 0.50:1.0, 0.48:1.0, or 0.46:1.0.

Preferably, any reductant used to convert some of the initial hexavalent chromium content to trivalent chromium produces from itself when oxidized only water and gaseous products such as carbon dioxide, which escape from the compositions. However, some other product or products formed by oxidation of the reductant may remain in a composition according to the invention as optional component (F).

The presence of film forming component (G) and/or siliceous component (H) in a composition according to the present invention can improve the corrosion resistance of the chromate film coated product in certain instances, but is not normally particularly preferred, especially in a concentrated aqueous solution according to the invention. A variety of materials known per se in the art can constitute component (G) if its presence is desired. If component (H) is present, it is preferably constituted of stably suspended silica, a widely available commercial product.

Compositions according to the invention preferably have no evidence of phase stratification visible to unaided normal human vision; i.e., the compositions may be cloudy or otherwise show evidence of suspended second phases, but preferably do not stratify into more than one liquid layer or contain any solid particles large enough to see individually with unaided normal human vision. If this condition is not fulfilled, there is always some danger of concentration variations due to inhomogeneity of the composition. Additionally and independently, concentrated aqueous solutions according to the invention preferably remain free from any precipitate detectable with normal human vision for a period of at least, with increasing preference in the order given, 5, 10, 20, 40, 60, 100, 150, or 300 days when stored at 20° to 25° C. without mechanical disturbance.

Concentrated aqueous solutions according to the invention are intended for use primarily as single-package concentrates that can be converted to working compositions according to the invention by dilution with water only. If desired for any reason, however, the concentrated aqueous solutions may also be formulated as multi-part concentrates, two or more of which are needed to form a complete working composition according to the invention.

In working compositions according to the invention, the concentrations of active ingredients as described above preferably are one-tenth of those specified above for the same ingredients in concentrated aqueous solutions according to the invention, with the same relative preferences as specified for the corresponding ingredients in concentrated aqueous solutions according to the invention. Thus, for example, in a working composition according to the invention, the total phosphate concentration preferably is at least, with increasing preference in the order given, 2.0, 3.0, 4.0, 5.0, 6.0, 7.0, 7.5, 8.0, 8.5, 9.0, or 9.2 g/L and independently preferably is not more than, with increasing preference in the order given, 30, 25, 22.5, 20.0, 17.5, 15.0, 12.5, 11.5, 10.5, 10.0, or 9.5 g/L.

A process of treating a metal substrate surface according to the invention may be performed over a wide range of times and at any temperature between the freezing and boiling points of the liquid working composition according to the invention that is used in the process. However, one of the most common uses of a process according to the invention is expected to be in coil processing, and at least for that use, fast processing is highly desirable economically; in particular, the time of contact between a metal substrate being treated and a working composition according to the invention preferably is not more than, with increasing preference in the order given, 5000, 2000, 1000, 600, 300, 150, 100, 75, 50, 40, 30, 25, 20, 15, 12, 10, 8, or 6 seconds. The time of contact should be enough to obtain an add-on mass of chromium from the treatment that is at least, with increasing preference in the order given, 1.0, 3.0, 5.0, 7.0, 8.0, 9.0, 10.0, 11.0, 11.8, 12.5, 13.0, 13.5, 14.0, or 14.5 milligrams of chromium per square meter (hereinafter usually abbreviated as "mg/$M^2$") of metal surface contacted, inasmuch as sufficient corrosion protection is not likely to be achieved from smaller add-on masses of chromium than 1.0 mg/$M^2$. The various preferred levels of chromium add-on can be readily achieved in a few seconds of contact at a reasonable temperature; in particular, the temperature of a working composition according to the invention during contact with a metal substrate in a process according to the invention preferably is at least, with increasing preference in the order given, 30°, 35°, 40°, 45°, or 48° C. and independently, primarily for reasons of economy, preferably is not more than, with increasing preference in the order given, 90°, 85°, 80°, 75°, 70°, 67°, 64°, or 61° C.

A process according to the invention may also include other steps that are conventional per se, such as cleaning the metal prior to treatment according to the invention, rinsing, drying the metal after treating it with a working composition according to the invention, and subsequently protectively coating the treated substrate with paint. Among these additional steps, cleaning before contact with a working composition according to the invention and rinsing after cleaning are generally preferred, but rinsing after contact with a working composition according to the invention is generally not preferred; instead, any excess liquid working composition preferably is allowed to drain from the surface of the substrate being treated or is removed therefrom by a squeegee or similar wiping device, and the remaining composition is dried into place on the surface being treated to form a protective film according to the invention.

The invention is illustrated in greater detail below by working examples, and the benefits of the invention are illustrated by comparison examples.

EXAMPLES AND COMPARISON EXAMPLES

Example Group 1

Stock Solution 1 for testing various concentrations of free fluoride and complex fluoride was prepared as follows: A chemically non-reactive container was charged with 590 parts of tap water, 100 parts of an orthophosphoric acid solution that contained 75% of orthophosphoric acid in water, and 100 parts of solid chromium trioxide. This mixture was heated to 49° C. and stirred until all of the chromium trioxide had dissolved. Successive portions of 5, 5, and 4 parts of ELVANOL™ 71-30, a solid powder commercially supplied by Du Pont and reported by its supplier to be a fully hydrolyzed, moderate viscosity, film forming polyvinylalcohol, were then added to the previously prepared solution. The addition of this reductant causes an exothermic reaction by reducing part of the hexavalent chromium content of the solution to trivalent chromium, and, after the addition of each of the first two portions, the mixture was stirred while being maintained within a temperature range from 60°–71° C. for 15 minutes and then cooled to 38° C. before the next portion was added. After the third addition of reductant, the mixture was stirred while being maintained within a temperature range from 60°–71° C. for 15 minutes, then raised to and maintained within a temperature range from 77° to 82° C. for two hours with stirring, and then cooled to 66° C. An additional amount of 130 parts of $CrO_3$ was then added; after this addition the solution was reheated to 82° C. and maintained at that temperature for 30 minutes, then cooled overnight to an ambient temperature within the range from 20°–25° C. to complete preparation of the stock solution. Two concentrated aqueous solutions according to the invention were made from Stock Solution 1, as shown in Table 1 below.

Each concentrated aqueous solution as described in Table 1 was divided into three approximately equal parts, and one part of each concentrated aqueous solution was stored, in a closed container, at each of the temperatures 20°–25° (normal ambient), 38°, and 49° C. and monitored for evidence of precipitation or other deterioration. No such evidence was observed after 18 hours, 14 days, 20 days, or 39 days of storage at any of these temperatures.

TABLE 1

CONCENTRATED AQUEOUS SOLUTIONS FROM GROUP 1

| | Parts by Weight of Constituent in Solution Number: | |
|---|---|---|
| Constituent | 1.1 | 1.2 |
| Stock Solution 1 | 187 | 187 |
| 45% $H_2ZrF_6$ in Water | 1.0 | 1.9 |
| 48% HF in Water | 15.2 | 7.6 |
| Additional Water | 0.00 | 3.7 |

Example and Comparison Example Group 2

Stock Solution 2 for testing additional concentrations of free fluoride and complex fluoride was prepared as follows: A chemically non-reactive container was charged with 236 parts of tap water, 40 parts of an orthophosphoric acid solution containing 75% of orthophosphoric acid in water, and 40 parts of solid chromium trioxide. This mixture was heated to 49° C. and stirred until all of the chromium trioxide had dissolved.

Successive portions of 2.0, 2.0, and 1.6 parts of ELVANOL™ 71-30 as above were then added to the previously prepared solution. After the addition of each of the first two portions, the mixture was stirred while being maintained within a temperature range from 60°–71° C. for 15 minutes and then cooled to 38° C. before the next portion was added. After the third addition of reductant, the mixture was stirred while being maintained within a temperature range from 60°–71° C. for 15 minutes, then raised to and maintained within a temperature range from 77° to 82° C. for two hours with stirring, and then cooled to 66° C. An additional amount of 52 parts of $CrO_3$ was then added; after this addition the solution was reheated to 82° C. and maintained at that temperature for 30 minutes. Then 5.6 parts of a 45% solution of fluozirconic acid in water were added and mixed into the previously made solution, which was then cooled overnight to an ambient temperature within the range from 20°–25° C. to complete preparation of Stock Solution 2. Various concentrated aqueous solutions, among which only those containing HF can be according to the invention, were made from Stock Solution 2 as shown in Table 2.1 below.

TABLE 2.1

CONCENTRATED AQUEOUS SOLUTIONS FROM GROUP 2

| | Parts by Weight of Constituent in Solution Number: | | | |
|---|---|---|---|---|
| Constituent | 2.1 | 2.2 | 2.3 | 2.4 |
| Stock Solution 2 | 948 | 948 | 948 | 948 |
| 48% RF in Water | 0.00 | 1.00 | 5.5 | 10.0 |
| Additional Water | 52 | 51 | 46 | 42 |

Each concentrated aqueous solution as described in Table 2.1 was divided into several parts, and one part of the concentrated aqueous solution was stored, in a closed container, at each of the temperatures 20°–25° (normal ambient), 38°, and 49° C. and was monitored for evidence of precipitation or other deterioration. After 8 days of storage, the observations shown in Table 2.2 were made.

TABLE 2.2

STORAGE STABILITY OF CONCENTRATES OF GROUP 2 (8 DAYS)

| Solution Number | Amount of Precipitate Visible after Storage at: | | |
|---|---|---|---|
| from Table 2.1 | Ambient | 38° C. | 49° C. |
| 2.1 | None | Very slight | Very slight |
| 2.2 | None | Very slight | Very slight |
| 2.3 | None | None | None |
| 2.4 | None | None | None |

The same solutions were continued in storage for a total of 14 days under the same conditions, with the results shown in Table 2.3 below. These same samples were maintained for a total of 33 days at 38° and 49° C., and the results after this time were identical to those as shown in Table 2.3. However, after 56 days of continued storage at ambient temperature, solutions 2.1 and 2.2 had developed precipitates, as the same compositions had earlier when stored at the two higher temperatures. Other results as shown in Table 2.3 remained unchanged after 56 days.

TABLE 2.3

STORAGE STABILITY OF CONCENTRATES OF GROUP 2 (14 DAYS)

| Solution Number | Precipitate Visible after Storage at: | | |
|---|---|---|---|
| from Table 2.1 | Ambient | 38° C. | 49° C. |
| 2.1 | No | Yes | Yes |
| 2.2 | No | Yes | Yes |
| 2.3 | No | No | No |
| 2.4 | No | No | No |

Other portions of the same concentrated aqueous solutions were used to prepare working compositions for passivating GALVALUME™ zinc-aluminum alloy (hereinafter usually abbreviated as "GALV") and hot-dip galvanized steel (hereinafter usually abbreviated as "HDG") substrate test panels, according to the following process sequence:

1. Clean for 5 seconds by spraying with an aqueous solution having a temperature of 54° C. and made to contain 7–10 "points" of PARCO® Cleaner 338, commercially supplied by the Parker Amchem Div. of Henkel Corp., Madison Heights, Mich. (hereinafter usually abbreviated as "PA") used according to the manufacturer's directions as given in PA Technical Process Bulletin No. 344 of Mar. 22, 1994.
2. Rinse with hot water for 5 seconds.
3. Treat with a working composition according to the invention or comparison working composition as described more fully below.
4. Squeegee off excess working composition and dry treated substrates.

After this process, the chromium add-on mass was measured using a commercially available instrument, a PORTASPEC™ Model 2501 X-ray spectrograph from Cianflone Scientific, according to the manufacturer's directions, and the treated substrates were tested by Salt Spray, American Society for Testing and Materials (hereinafter usually abbreviated as "ASTM") Procedure B-117-90; Cleveland Condensation, ASTM Procedure D4585-87; and/or a "Stack Test". In this latter test, one member of a pair of test panels of the same size is sprayed lightly with deionized water to form a film on the surface, and the other member of the pair is placed over the water sprayed surface and compressed against it by a substantial weight. If the test specimen has one side more likely than the other to be exposed in subsequent use, this "prime side" is the one sprayed with water and then placed internally in the pair stack, which in the tests reported below included three such replicate pairs, for a total of six individual specimens. The stacks are then placed in a cabinet maintained at 100% relative humidity and at 71° C. After predetermined intervals of such exposure, the stacks are opened so that the interior surface of each panel in the stack can be examined for evidence of white, black, or red "rust". The percentage of the surface area showing any of these colors of rust is divided by 10, and the resulting quotient is subtracted from 10 to give a rating score, which thus runs from 10, indicating a completely unrusted and thus best quality surface, to 0 for a completely rusted surface. After the first such examination, the stack is usually reassembled and returned to the same constant humidity and temperature controlled cabinet for continued testing.

The details of step 3 of this process sequence and the results of the add-on mass measurements are given in Table 2.4 below, and the results of these tests are shown in Tables 2.5–2.9 below. The results in Tables 2.5–2.9, although not highly precise, as is usual with the types of tests performed, clearly trend toward better corrosion resistance with increased concentrations of free fluoride ions in the working compositions.

Example Group 3

A concentrate according to the invention was prepared as follows: A chemically non-reactive container was charged with 590 parts of tap water, 100 parts of an orthophosphoric acid solution containing 75% of orthophosphoric acid in water, and 230 parts of solid chromium trioxide. This mixture was heated to 38° C. and stirred until all of the chromium trioxide had dissolved. Successive portions of 5, 5, and 7 parts of ELVANOL™ 71-30 as described in detail above were then added to the previously prepared solution. The addition of this reductant produces an exothermic reaction by reducing part of the hexavalent chromium content of the solution to trivalent chromium, and, after the addition of each of the first two portions, the mixture was stirred while being maintained within a temperature range from 60°–71° C. for 15 minutes and then cooled to 38° C. before the next portion was added. After the third addition of reductant, the mixture was stirred while being maintained within a temperature range from 60°–71° C. for 15 minutes, then raised to and maintained within a temperature range from 77° to 82° C. for two hours with stirring, and then cooled to 38° C. Fourteen (14) parts of an aqueous solution of fluozirconic acid containing 45% of fluozirconic acid and 5.5 parts of an aqueous solution of hydrogen fluoride containing 48% of hydrogen fluoride were then added to the previously made mixture, which was stirred at 38° C. for another 30 minutes. Finally, a sufficient amount of tap water to bring the total mixture to 1000 parts was added.

TABLE 2.4

PROCESS AND ADD-ON MASS DETAILS, GROUP 2

| Substrate Type | Process Conditions: Working Composition | Temperature, °C. | Immersion Time, Seconds | Add-On Mass of Cr, mg/M$^2$ | Designating Number |
|---|---|---|---|---|---|
| HDG | 10% in Water of Concentrate 2.1 | 53 | 5 | 12.2 | 2.1.x |
| | 10% in Water of Concentrate 2.2 | 49 | 7 | 12.3 | 2.2.x |
| | 10% in Water of Concentrate 2.3 | 48 | 5 | 11.9 | 2.3.x |
| | 10% in Water of Concentrate 2.4 | 49 | 5 | 14.9 | 2.4.x |
| GALV | 10% in Water of Concentrate 2.1 | 50 | 5 | 12.1 | 2.1.x |
| | 10% in Water of Concentrate 2.2 | 60 | 5 | 11.6 | 2.2.x |
| | 10% in Water of Concentrate 2.3 | 50 | 5 | 12.4 | 2.3.x |
| | 10% in Water of Concentrate 2.4 | 63 | 5 | 14.2 | 2.4.x |

Note for Table 2.4

The "Designating Number" shown in the rightmost column of the Table is the number by which test panels treated as described are identified in the tables below that report the test results; the "x" in the Designating Number is an arbitrary integer identifying a replicate test panel treated by the same process as any other test panel with the same first two identifying integers, except that in the Stack Test each odd numbered panel was paired with the next higher even numbered panel.

TABLE 2.5

SALT SPRAY TEST RESULTS ON GALV SUBSTRATES

| Specimen Number | Percent of Surface Showing White Rust after Exposure Time, Days: 1 | 2 | 3 | 4 | 5 | 6 | 7 |
|---|---|---|---|---|---|---|---|
| 2.1.1 | 0 | 0 | 0 | 0 | 0 | 0 | 0 |
| 2.1.2 | 0 | 0 | 0 | 0 | 0 | 0 | 0 |
| 2.2.1 | 0 | 0 | 0 | 0 | 0 | 0 | 0 |
| 2.2.2 | 0 | 0 | 0 | 0 | 0 | 0 | 0 |
| 2.3.1 | 0 | 0 | 0 | 0 | 0 | 1 | 1 |
| 2.3.2 | 0 | 0 | 0 | 0 | 0 | 0 | 0 |
| 2.4.1 | 0 | 0 | 0 | 0 | 0 | 0 | 0 |
| 2.4.2 | 0 | 0 | 0 | 0 | 0 | 0 | 0 |

TABLE 2.6

SALT SPRAY TEST RESULTS ON HDG SUBSTRATES

| Specimen Number | Percent of Surface Showing White Rust after Exposure Time, Days: 1 | 2 | 3 | 4 | 5 | 6 | 7 |
|---|---|---|---|---|---|---|---|
| 2.1.1 | N | N | 5 | n.o. | n.o. | 75 | 92 |
| 2.1.2 | N | N | 1 | n.o. | n.o. | 20 | 60 |
| 2.2.1 | N | N | 10 | n.o. | n.o. | 50 | 78 |
| 2.2.2 | N | N | 1 | n.o. | n.o. | 10 | 43 |
| 2.3.1 | N | N | 5 | n.o. | n.o. | 20 | 49 |
| 2.3.2 | N | N | 1 | n.o. | n.o. | 10 | 32 |
| 2.4.1 | N | N | 3 | n.o. | n.o. | 10 | 42 |
| 2.4.2 | N | N | 1 | n.o. | n.o. | 5 | 20 |

Abbreviation for Table 2.6

TABLE 2.6-continued

SALT SPRAY TEST RESULTS ON HDG SUBSTRATES

| Specimen | Percent of Surface Showing White Rust after Exposure Time, Days: | | | | | | |
|---|---|---|---|---|---|---|---|
| Number | 1 | 2 | 3 | 4 | 5 | 6 | 7 |

n.o. = n.o. observation made;
N = nil (= 0).

TABLE 2.7

STACK TEST RESULTS ON GALV SUBSTRATES

| Designating Number of Substrate | Rating After Exposure for a Time in Hours of: 168 | 384 | 504 | 672 |
|---|---|---|---|---|
| 2.1.1 | 10 | 9 | 8 | 7 |
| 2.1.2 | 10 | 9 | 8 | 7 |
| 2.1.3 | 10 | $9^+$ | 9 | 9 |
| 2.1.4 | 10 | $9^+$ | 9 | 9 |
| 2.1.5 | 10 | 10 | $9^+$ | 9 |
| 2.1.6 | 10 | 10 | $9^+$ | 9 |
| 2.2.1 | 10 | 10 | $9^+$ | 9 |
| 2.2.2 | 10 | 10 | $9^+$ | 9 |
| 2.2.3 | 10 | 10 | 8 | 8 |
| 2.2.4 | 10 | $9^+$ | 8 | 8 |
| 2.2.5 | 10 | $9^+$ | 9 | 9 |
| 2.2.6 | 10 | $9^+$ | 9 | 9 |
| 2.3.1 | 10 | 10 | 9 | 7 |
| 2.3.2 | 10 | 10 | 9 | 7 |
| 2.3.3 | 10 | $9^+$ | 9 | 6 |
| 2.3.4 | 10 | $9^+$ | 9 | 6 |
| 2.3.5 | 10 | 10 | 9 | 5 |
| 2.3.6 | 10 | $9^+$ | 9 | 4 |
| 2.4.1 | 10 | 10 | 10 | 10 |
| 2.4.2 | 10 | 10 | 10 | 10 |
| 2.4.3 | 10 | 10 | 10 | 10 |
| 2.4.4 | 10 | 10 | 10 | 10 |
| 2.4.5 | 10 | 10 | 10 | 10 |
| 2.4.6 | 10 | 10 | 10 | 10 |

TABLE 2.8

STACK TEST RESULTS ON HDG SUBSTRATES

| Designating Number of Substrate | Rating After Exposure for a Time in Hours of: 168 | 336 | 504 | 672 |
|---|---|---|---|---|
| 2.1.1 | 9 | 7 | 3 | 1 |
| 2.1.2 | 9 | 7 | 3 | 2 |
| 2.1.3 | 7 | 5 | 1 | 1 |
| 2.1.4 | 7 | 5 | 1 | 1 |
| 2.1.5 | 9 | 7 | 3 | 2 |
| 2.1.6 | 9 | 7 | 3 | 2 |
| 2.2.1 | 7 | 5 | 1 | 1 |
| 2.2.2 | 7 | 5 | 1 | 1 |
| 2.2.3 | 8 | 6 | 1 | 1 |
| 2.2.4 | 8 | 6 | 1 | 1 |
| 2.2.5 | 9 | 7 | 5 | 2 |
| 2.2.6 | 9 | 7 | 5 | 2 |
| 2.3.1 | 8 | 6 | 4 | 3 |
| 2.3.2 | 8 | 6 | 4 | 3 |
| 2.3.3 | 8 | 6 | 4 | 3 |
| 2.3.4 | 8 | 6 | 4 | 3 |
| 2.3.5 | 10 | 8 | 5 | 3 |
| 2.3.6 | 10* | 8 | 6 | 4 |
| 2.4.1 | 10* | 8** | 6 | 4 |
| 2.4.2 | 10* | 8** | 6 | 4 |
| 2.4.3 | 10* | 8** | 5 | 2 |
| 2.4.4 | 10* | 8** | 5 | 2 |

TABLE 2.8-continued

STACK TEST RESULTS ON HDG SUBSTRATES

| Designating Number of Substrate | Rating After Exposure for a Time in Hours of: 168 | 336 | 504 | 672 |
|---|---|---|---|---|
| 2.4.5 | 10* | 8** | 5 | 3 |
| 2.4.6 | 10* | 8** | 5 | 3 |

*Specimen surface discolored, but no evidence of corrosion products.
**Specimen surface discolored.

TABLE 2.9

CLEVELAND CONDENSATION TEST RESULTS ON GALV SUBSTRATES

| Specimen Number | Rating after Exposure Time, Hours: 72 | 336 | 672 |
|---|---|---|---|
| 2.1.1 | 10 | 4 | 3 |
| 2.1.2 | 10 | 9 | 7 |
| 2.2.1 | 10 | 7 | 6 |
| 2.2.2 | 10 | 7 | 6 |
| 2.3.1 | 10 | 7 | 7 |
| 2.3.2 | 10 | 10 | 9 |
| 2.4.1 | 10 | 10 | 10 |
| 2.4.2 | 10 | 9 | 9 |

The resulting concentrate was analyzed for residual hexavalent chromium, and from the result of this analysis the concentration of trivalent chromium was determined by assuming that the difference between the initial and final concentrations of hexavalent chromium was now present as trivalent chromium instead. The resulting concentrate had chemical and physical characteristics shown in Table 3 below.

A solution in water of 5 to 10% of this concentrate is an effective working composition according to this invention.

TABLE 3

CHARACTERISTICS OF CONCENTRATED AQUEOUS SOLUTION OF EXAMPLE GROUP 3

| Ingredient | Concentration in g/L of This Ingredient |
|---|---|
| $PO_4^{-3}$ anions | 92.3 |
| Stoichiometric equivalent as $CrO_3$ of total chromium | 292 |
| $ZrF_6^{-2}$ anions | 7.92 |
| Stoichiometric equivalent as HF of free fluoride content | 3.35 |
| Molar ratio of trivalent Cr to total Cr: | 0.456 |
| Specific gravity: | 1.27 |

The invention claimed is:

1. A concentrated aqueous solution suitable for being diluted with water to form an effective working composition for forming a chromium containing conversion coating on a metal surface by chemical reaction, without the need for any external electromotive force, during contact between the working composition and the metal surface, said concentrated aqueous solution comprising water and:

(A) a concentration of from about 20 to about 300 g/L of phosphate ions;

(B) a concentration of total dissolved chromium corresponding stoichiometrically to from about 75 to about 350 g/L of $CrO_3$;

(C) a total concentration from about 0.010 to about 0.40 M/L of a component of dissolved anions selected from the group consisting of $BF_4^-$, $SiF_6^{-2}$, $TiF_6^{-2}$, and $ZrF_6^{-2}$; and (D) a concentration of dissolved free fluoride ions that corresponds stoichiometrically to from about 0.3 to about 25 g/L of HF; and, optionally, (E) a component of dissolved trivalent chromium.

2. A concentrated aqueous solution according to claim 1, wherein: total chromium, measured as its stoichiometric equivalent as $CrO_3$, is present in a concentration that has a ratio to the concentration of phosphate ions that is from about 0.50:1.0 to about 5.0:1.0; component (C) is present in a total concentration from about 0.0140 to about 0.40 M/L; the concentration of phosphate ions in moles per liter has a ratio to the total concentration of component (C) in moles per liter that is from about 5:1.0 to 100:1.0; free fluoride, measured as its stoichiometric equivalent as HF, is present in a concentration in moles per liter that has a ratio to the total concentration of component (C) in moles per liter that is from about 2.0:1.0 to about 50:1.0.

3. A concentrated aqueous solution according to claim 2, wherein dissolved trivalent chromium atoms are present in an amount having a ratio to total dissolved chromium atoms within a range from about 0.20:1.0 to about 0.60:1.0.

4. A concentrated aqueous solution according to claim 3, wherein the trivalent chromium atoms present were generated in situ by reduction of previously hexavalent dissolved chromium atoms.

5. A concentrated aqueous solution according to claim 3, wherein component (C) is selected from the group consisting of fluozirconate ions, fluotitanate ions, and mixtures of fluozirconate and fluotitanate ions.

6. A concentrated aqueous solution according to claim 5, wherein: phosphate ions are present in a concentration from about 40 to about 200 g/L; total chromium, measured as its stoichiometric equivalent as $CrO_3$, is present in a concentration that is from about 125 to about 350 g/L and has a ratio to the concentration of phosphate ions that is from about 1.25:1.0 to about 5.0:1.0; component (C) is present in a total concentration from about 0.014 to about 0.20 M/L; the concentration of phosphate ions in moles per liter has a ratio to the total concentration of component (C) in moles per liter that is from about 9:1.0 to 60:1.0; and free fluoride, measured as its stoichiometric equivalent as HF, is present in a concentration from about 0.7 to about 10 g/L, corresponding to a value in moles per liter that has a ratio to the total concentration of component (C) in moles per liter that is from about 2.5:1.0 to about 40:1.0.

7. A concentrated aqueous solution according to claim 6, wherein: phosphate ions are present in a concentration from about 50 to about 175 g/L; total chromium, measured as its stoichiometric equivalent as $CrO_3$, is present in a concentration that is from about 150 to about 350 g/L and has a ratio to the concentration of phosphate ions that is from about 1.75:1.0 to about 5.0:1.0; component (C) is present in a total concentration from about 0.018 to about 0.12 M/L; the concentration of phosphate ions in moles per liter has a ratio to the total concentration of component (C) in moles per liter that is from about 13:1.0 to 55:1.0; and free fluoride, measured as its stoichiometric equivalent as HF, is present in a concentration from about 1.5 to about 7.0 g/L, corresponding to a value in moles per liter that has a ratio to the total concentration of component (C) in moles per liter that is from about 3.0:1.0 to about 20:1.0.

8. A concentrated aqueous solution according to claim 7, wherein: phosphate ions are present in a concentration from about 60 to about 150 g/L; total chromium, measured as its stoichiometric equivalent as $CrO_3$, is present in a concentration that is from about 175 to about 350 g/L and has a ratio to the concentration of phosphate ions that is from about 2.25:1.0 to about 5.0:1.0; component (C) is present in a total concentration from about 0.022 to about 0.070 M/L; the concentration of phosphate ions in moles per liter has a ratio to the total concentration of component (C) in moles per liter that is from about 15:1.0 to 45:1.0; free fluoride, measured as its stoichiometric equivalent as HF, is present in a concentration from about 2.1 to about 6.0 g/L, corresponding to a value in moles per liter that has a ratio to the total concentration of component (C) in moles per liter that is from about 3.5:1.0 to about 12:1.0; and dissolved trivalent chromium atoms are present in an amount having a ratio to total dissolved chromium atoms within a range from about 0.25:1.0 to about 0.60:1.0.

9. A concentrated aqueous solution according to claim 8, wherein: phosphate ions are present in a concentration from about 70 to about 125 g/L; total chromium, measured as its stoichiometric equivalent as $CrO_3$, is present in a concentration that is from about 200 to about 350 g/L and has a ratio to the concentration of phosphate ions that is from about 2.85:1.0 to about 4.0:1.0; component (C) consists essentially of fluozirconate anions and is present in a total concentration from about 0.026 to about 0.055 M/L; the concentration of phosphate ions in moles per liter has a ratio to the total concentration of component (C) in moles per liter that is from about 19:1.0 to 35:1.0; free fluoride, measured as its stoichiometric equivalent as HF, is present in a concentration from about 2.5 to about 5.0 g/L, corresponding to a value in moles per liter that has a ratio to the total concentration of component (C) in moles per liter that is from about 3.8:1.0 to about 8.0:1.0; and dissolved trivalent chromium atoms are present in an amount having a ratio to total dissolved chromium atoms within a range from about 0.35:1.0 to about 0.57:1.0.

10. A concentrated aqueous solution according to claim 9, wherein: phosphate ions are present in a concentration from about 85 to about 105 g/L; total chromium, measured as its stoichiometric equivalent as $CrO_3$, is present in a concentration that is from about 225 to about 350 g/L and has a ratio to the concentration of phosphate ions that is from about 3.05:1.0 to about 3.3:1.0; component (C) is present in a total concentration from about 0.030 to about 0.046 M/L; the concentration of phosphate ions in moles per liter has a ratio to the total concentration of component (C) in moles per liter that is from about 23:1.0 to 31:1.0; free fluoride, measured as its stoichiometric equivalent as HF, is present in a concentration from about 3.1 to about 4.5 g/L, corresponding to a value in moles per liter that has a ratio to the total concentration of component (C) in moles per liter that is from about 4.1:1.0 to about 4.8:1.0; and dissolved trivalent chromium atoms are present in an amount having a ratio to total dissolved chromium atoms within a range from about 0.40:1.0 to about 0.48:1.0.

11. A process for forming a chromium-containing conversion coating on a metal substrate surface, said process comprising steps of:

(I) contacting the metal substrate surface, for a sufficient time at a sufficient temperature to form an adherent coating that contains at least 1.0 $mg/M^2$ of chromium on the metal substrate surface, with an aqueous liquid composition comprising water and:

(A) a concentration of from about 2.0 to about 30.0 g/L of phosphate ions;

(B) a concentration of total dissolved chromium corresponding stoichiometrically to from about 7.5 to about 35.0 g/L of $CrO_3$;

(C) a total concentration from about 0.0010 to about 0.040 M/L of a component of dissolved anions selected from the group consisting of $BF_4^-$, $SiF_6^{-2}$, $TiF_6^{-2}$, and $ZrF_6^{-2}$; and (D) a concentration of dissolved free fluoride ions that corresponds stoichiometrically to from about 0.03 to about 2.5 g/L of HF; and, optionally, (E) a component of dissolved trivalent chromium; and (II) discontinuing contact between the metal substrate surface and the aqueous liquid composition with which it is contacted in step (I).

12. A process according to claim 11, wherein the coating formed in step (I) contains at least 3.0 mg/$M^2$ of chromium and, in the aqueous liquid composition used in step (I): total chromium, measured as its stoichiometric equivalent as $CrO_3$, is present in a concentration that has a ratio to the concentration of phosphate ions that is from about 0.50:1.0 to about 5.0:1.0; component (C) is present in a total concentration from about 0.0014 to about 0.040 M/L; the concentration of phosphate ions in moles per liter has a ratio to the total concentration of component (C) in moles per liter that is from about 5:1.0 to 100:1.0; free fluoride, measured as its stoichiometric equivalent as HF, is present in a concentration in moles per liter that has a ratio to the total concentration of component (C) in moles per liter that is from about 2.0:1.0 to about 50:1.0.

13. A process according to claim 12, wherein, in the aqueous liquid composition used in step (I), dissolved trivalent chromium atoms are present in an amount having a ratio to total dissolved chromium atoms within a range from about 0.20:1.0 to about 0.60:1.0.

14. A process according to claim 13, wherein, in the aqueous liquid composition used in step (I), the trivalent chromium atoms present were generated in situ by reduction of previously hexavalent dissolved chromium atoms.

15. A process according to claim 13, wherein, in the aqueous liquid composition used in step (I), component (C) is selected from the group consisting of fluozirconate ions, fluotitanate ions, and mixtures of fluozirconate and fluotitanate ions.

16. A process according to claim 15, wherein the temperature of the aqueous liquid composition when contacted in step (I) with the metal substrate surface is at least 30° C., the time of contact during step (I) is not more than 30 seconds, and, in the aqueous liquid composition used in step (I): phosphate ions are present in a concentration from about 4.0 to about 20.0 g/L; total chromium, measured as its stoichiometric equivalent as $CrO_3$, is present in a concentration that is from about 12.5 to about 35.0 g/L and has a ratio to the concentration of phosphate ions that is from about 1.25:1.0 to about 5.0:1.0; component (C) is present in a total concentration from about 0.0014 to about 0.020 M/L; the concentration of phosphate ions in moles per liter has a ratio to the total concentration of component (C) in moles per liter that is from about 9:1.0 to 60:1.0; and free fluoride, measured as its stoichiometric equivalent as HF, is present in a concentration from about 0.07 to about 1.0 g/L, corresponding to a value in moles per liter that has a ratio to the total concentration of component (C) in moles per liter that is from about 2.5:1.0 to about 40:1.0.

17. A process according to claim 16, wherein the temperature of the aqueous liquid composition when contacted in step (I) with the metal substrate surface is at least 35° C., the time of contact during step (I) is not more than 25 seconds, the adherent coating formed on the metal substrate during step (I) contains at least 7.0 mg/$M^2$ of chromium, and, in the aqueous liquid composition used in step (I): phosphate ions are present in a concentration from about 5.0 to about 17.5 g/L; total chromium, measured as its stoichiometric equivalent as $CrO_3$, is present in a concentration that is from about 15.0 to about 35.0 g/L and has a ratio to the concentration of phosphate ions that is from about 1.75:1.0 to about 5.0:1.0; component (C) is present in a total concentration from about 0.0018 to about 0.012 M/L; the concentration of phosphate ions in moles per liter has a ratio to the total concentration of component (C) in moles per liter that is from about 13:1.0 to 55:1.0; and free fluoride, measured as its stoichiometric equivalent as HF, is present in a concentration from about 0.15 to about 0.70 g/L, corresponding to a value in moles per liter that has a ratio to the total concentration of component (C) in moles per liter that is from about 3.0:1.0 to about 20:1.0.

18. A process according to claim 17, wherein the temperature of the aqueous liquid composition when contacted in step (I) with the metal substrate surface is at least 40° C., the time of contact during step (I) is not more than 20 seconds, the adherent coating formed on the metal substrate during step (I) contains at least 8.0 mg/$M^2$ of chromium, and, in the aqueous liquid composition used in step (I): phosphate ions are present in a concentration from about 6.0 to about 15.0 g/L; total chromium, measured as its stoichiometric equivalent as $CrO_3$, is present in a concentration that is from about 17.5 to about 35.0 g/L and has a ratio to the concentration of phosphate ions that is from about 2.25:1.0 to about 5.0:1.0; component (C) is present in a total concentration from about 0.0022 to about 0.0070 M/L; the concentration of phosphate ions in moles per liter has a ratio to the total concentration of component (C) in moles per liter that is from about 15:1.0 to 45:1.0; free fluoride, measured as its stoichiometric equivalent as HF, is present in a concentration from about 0.21 to about 0.6 g/L, corresponding to a value in moles per liter that has a ratio to the total concentration of component (C) in moles per liter that is from about 3.5:1.0 to about 12:1.0; and dissolved trivalent chromium atoms are present in an amount having a ratio to total dissolved chromium atoms within a range from about 0.25:1.0 to about 0.60:1.0.

19. A process according to claim 18, wherein the temperature of the aqueous liquid composition when contacted in step (I) with the metal substrate surface is at least 40° C., the time of contact during step (I) is not more than 15 seconds, the adherent coating formed on the metal substrate during step (I) contains at least 11.0 mg/$M^2$ of chromium, and, in the aqueous liquid composition used in step (I): phosphate ions are present in a concentration from about 7.0 to about 12.5 g/L; total chromium, measured as its stoichiometric equivalent as $CrO_3$, is present in a concentration that is from about 20.0 to about 35.0 g/L and has a ratio to the concentration of phosphate ions that is from about 2.85:1.0 to about 4.0:1.0; component (C) consists essentially of fluozirconate anions and is present in a total concentration from about 0.0026 to about 0.0055 M/L; the concentration of phosphate ions in moles per liter has a ratio to the total concentration of component (C) in moles per liter that is from about 19:1.0 to 35:1.0; free fluoride, measured as its stoichiometric equivalent as HF, is present in a concentration from about 0.25 to about 0.50 g/L, corresponding to a value in moles per liter that has a ratio to the total concentration of component (C) in moles per liter that is from about 3.8:1.0 to about 8.0:1.0; and dissolved trivalent chromium atoms are present in an amount having a ratio to total dissolved chromium atoms within a range from about 0.35:1.0 to about 0.57:1.0.

20. A process according to claim 19, wherein the temperature of the aqueous liquid composition when contacted in step (I) with the metal substrate surface is at least 45° C., the time of contact during step (I) is not more than 8 seconds, the adherent coating formed on the metal substrate during step (I) contains at least 11.8 mg/$M^2$ of chromium, and, in the aqueous liquid composition used in step (I): phosphate ions are present in a concentration from about 8.5 to about 10.5 g/L; total chromium, measured as its stoichiometric equivalent as $CrO_3$, is present in a concentration that is from about 22.5 to about 35.0 g/L and has a ratio to the concentration of phosphate ions that is from about 3.05:1.0 to about 3.3:1.0; component (C) is present in a total concentration from about 0.0030 to about 0.0046 M/L; the concentration of phosphate ions in moles per liter has a ratio to the total concentration of component (C) in moles per liter that is from about 23:1.0 to 31:1.0; free fluoride, measured as its stoichiometric equivalent as HF, is present in a concentration from about 0.31 to about 0.45 g/L, corresponding to a value in moles per liter that has a ratio to the total concentration of component (C) in moles per liter that is from about 4.1:1.0 to about 4.8:1.0; and dissolved trivalent chromium atoms are present in an amount having a ratio to total dissolved chromium atoms within a range from about 0.40:1.0 to about 0.48:1.0.

* * * * *